United States Patent [19]

Haga

[11] Patent Number: 4,772,542

[45] Date of Patent: Sep. 20, 1988

[54] SILVER HALIDE PHOTOGRAPHIC MATERIAL

[75] Inventor: Yoshihiro Haga, Uenohara, Japan

[73] Assignee: Konishiroku Photo Industry Co., Ltd., Tokyo, Japan

[21] Appl. No.: 97,283

[22] Filed: Sep. 11, 1987

Related U.S. Application Data

[63] Continuation of Ser. No. 852,075, Apr. 14, 1986, abandoned, which is a continuation of Ser. No. 649,426, Sep. 11, 1984, abandoned.

[30] Foreign Application Priority Data

Sep. 21, 1983 [JP] Japan ..... 58-174755

[51] Int. Cl.[4] ..... G03C 1/40; G03C 7/20; G03C 7/32

[52] U.S. Cl. ..... 430/383; 430/226; 430/376; 430/385; 430/387; 430/505; 430/506; 430/509

[58] Field of Search ..... 430/505, 506, 509, 383, 430/376, 385, 387, 226, 389, 217

[56] References Cited

U.S. PATENT DOCUMENTS

| | | | |
|---|---|---|---|
| 3,364,022 | 1/1968 | Barr | 430/505 |
| 3,620,747 | 4/1973 | Zorn et al. | 430/505 |
| 3,728,121 | 4/1973 | Zorn et al. | 430/505 |
| 4,153,460 | 5/1979 | Iijima et al. | 430/505 |
| 4,413,054 | 11/1983 | Mitsui et al. | 430/555 |
| 4,420,556 | 12/1983 | Booms et al. | 430/226 |
| 4,438,194 | 3/1984 | Hamada | 430/505 |
| 4,539,289 | 9/1985 | Saito et al. | 430/506 |
| 4,543,323 | 9/1985 | Iijima et al. | 430/506 |
| 4,652,515 | 3/1987 | Ogawa et al. | 430/506 |

FOREIGN PATENT DOCUMENTS 1560965 2/1980 United Kingdom .

*Primary Examiner*—Richard L. Schilling
*Attorney, Agent, or Firm*—Jordan B. Bierman

[57] ABSTRACT

A silver halide photographic material is disclosed. The material has at least one silver halide emulsion layer on a support, said silver halide emulsion layer containing a coupler which forms a mobile dye by coupling reaction with the oxidized product of a color developing agent, and said silver halide emulsion layer having in association therewith a non-light sensitive layer containing substantially non-light sensitive fine silver halide grains.

25 Claims, No Drawings

SILVER HALIDE PHOTOGRAPHIC MATERIAL

This application is a continuation of application Ser. No. 852,075, filed Apr. 14, 1986, now abandoned, which is a continuation of application Ser. No. 649,426, filed Sept. 11, 1984, now abandoned.

FIELD OF THE INVENTION

The present invention relates to a silver halide color photographic material, and, more particularly, to a silver halide color photographic material having high sensitivity and providing an image of good quality (particularly improved granularity).

BACKGROUND OF THE INVENTION

Silver halide color photographic materials, particularly those used in picture taking, are required to have specific properties such as high sensitivity and high quality image, especially good granularity. The demand for meeting these requirements is ever increasing today since the tendency toward using smaller cameras necessitates the reduction in the size of images such as in negative films. While many improvements have been made in technology of manufacturing silver halide color photographic materials and products with improved performance have been developed, most of them are unable to solve the problem of trade-off between the sensitivity and image quality. As is well known in the art, tremendous difficulty is involved in achieving a significant increase in the sensitivity of silver halide photographic materials, and there is no technology available today that is capable of increasing the sensitivity without impairing the resulting image quality (granularity, among other things). A particularly great difficulty is encountered in an attempt at increasing the sensitivity of a lower layer in a multi-layered silver halide color photographic material, i.e., a silver halide light-sensitive layer closer to the support, as well as at improving the quality (e.g. tone gradation) of the image formed in that layer, and no technology proposed to date has been found completely satisfactory. There are several factors that explain this difficulty: (1) "interlayer effect" or delayed diffusion of an aromatic primary amine developing agent into a light-sensitive layer closer to the support of a silver halide multi-layered color photographic material under development; (2) diffusion of a development retarding compound incorporated in that particular light-sensitive layer or in any other layer; (3) optical loss due to a non-sensitive layer or emulsion layer positioned in the upper part of the photographic material during exposure.

Various methods are known for sensitizing silver halide emulsions, and they include: modifying the step of physical ripening by, for example, making coarser silver halide grains; chemical sensitization with noble metal, sulfur, selenium or reduction sensitizers; spectral sensitization; sensitization by addition of fine silver halide grains to a silver halide emulsion; sensitization by addition of a silver halide solvent to the silver halide emulsion; and sensitization using a two-equivalent coupler or any other coupler that is capable of rapid reaction with the oxidized product of a developing agent.

Various techniques have also been proposed for providing an improved image quality. Particularly active efforts are being made to commercialize the method of incorporating in a silver halide color photographic material a compound that releases a development retarding compound during development. Two typical examples of this DIR compound are DIR-couplers (development inhibitor releasing couplers) that not only form a color dye by reaction with the oxidized product of a color developing agent but also release a development inhibitor, and DIR-hydroquinones or DIR-substances that release a development inhibitor but which are substantially incapable of forming a color dye upon reaction with the oxidized product of a color developing agent; these latter compounds form a colorless compound by reaction with the oxidized product of the color developing agent.

The use of these DIR compounds is highly effective for the purpose of providing an image of improved quality, but if they are combined with one of the known sensitizing techniques shown above, two serious defects arise. Firstly, the sensitivity of an emulsion layer containing a DIR compound that releases a development inhibitor imagewise during development is decreased due to the "interimage effect" that is detrimental to the development of that layer. This problem is particularly significant if the diffusibility of the development inhibitor released from the DIR compound (e.g. DIR-hydroquinone, DIR-substance or DIR-coupler) is small. The second problem is the "interimage effect" wherein the development inhibitor released upon development diffuses into an adjacent overlying or underlying emulsion layer, or even into an emulsion layer that is sensitive to light of a different color, and in that layer the inhibitor exhibits its development inhibiting action in accordance with the imagewise distribution specific to the layer where said inhibitor is initially incorporated. This interimage effect becomes significant if the released development inhibitor is a halide ion or organic heterocyclic compound having high diffusibility.

In order to avoid these two deleterious effects, the DIR compounds should be used in limited amounts, but then this makes it impossible to achieve the necessary sensitization by combining a particular DIR compound with one of the known sensitizing techniques; furthermore, the improvement in the image quality is far from being satis- factory.

Methods have been proposed for eliminating the above mentioned defects of using DIR compounds. According to one proposal, a non-light sensitive colloidal layer is placed adjacent to an emulsion layer containing a DIR compound. This adjacent layer contains substantially non-developable or low-sensitivity silver halide grains and is capable of adsorbing a development inhibitor released from the DIR compound. This non-sensitive layer per se is effective in reducing or limiting the adverse effects of the development inhibitor released from each silver halide color emulsion layer, and if this layer is placed adjacent each emulsion layer, the sensitivity of that emulsion layer is not greatly reduced. However, other serious defects occur, such as increased fog and reduced storage stability. These are fatal to the commercial value of the final photographic product.

The long felt need for providing a silver halide photographic material having high sensitivity and good image quality (especially high granularity) is yet to be satisfied.

SUMMARY OF THE INVENTION

The primary object of the present invention is to provide a silver halide color photographic material having high sensitivity and which forms a dye image having good granularity.

This object of the present invention can be achieved by a silver halide photographic material having at least one silver halide emulsion layer on a support, said silver halide emulsion layer containing a coupler which forms a mobile dye by entering into coupling reaction with the oxidized product of a color developing agent, said silver halide emulsion layer having in association therewith a non-light sensitive layer containing substantially non-light sensitive fine silver halide grains.

DETAILED DESCRIPTION OF THE INVENTION

Photographic sensitivity depends on three factors, i.e., the sensitivity of silver halide grains determined by the efficiency of photochemical reaction, the amount of light received by individual grains, and development efficciency. As already mentioned in connection with the prior art, there is a trade-off between the improvement of photographic sensitivity and that of image quality, particularly granularity. This problem cannot be simply solved by comulative combination of functional compounds. Instead, the present inventors took the approach of studying the behavior of the molecules or ions diffusing in a hydrophilic colloid jelly of a silver halide photographic material which is immersed in a developing solution. Upon development, silver halide generates highly diffusible halide ions (particularly, bromide ions) which retard continuous development of the layer in which such ions have been generated or a layer into which these ions are diffused. As a result of the desensitizing effect of this phenomenon, the color density is reduced (i.e., reduced tone reproduction). Furthermore, the coupler used for the purpose of providing an improved granularity generates a dye which may diffuse either excessively to impair the image acuity or insufficiently to cause poor granularity. In view of these facts, the present inventors studied the mechanism of the diffusion of the molecules or ions of various substances that affect the photographic sensitivity (hereunder simply referred to as sensitivity) and granularity in a hydrophilic colloid jelly of a photographic material. The present invention has been accomplished by controlling the behavior of such molecules or ions diffusing in the jelly and providing a properly adjusted environment for this diffusion.

The silver halide photographic material of the present invention comprises at least one silver halide emulsion layer formed on a support which contains a mobile dye forming coupler and a non-light sensitive layer provided in association with this silver halide emulsion layer and which contains substantially non-light sensitive fine silver halide grains. There is no particular limitation on the number of emulsion layers and non-light sensitive layers to be formed on the support, nor on the order of the arrangement of these layers.

The term "in association" used in this specification means that the two essential layers used in the photographic material of the invention are disposed in such a manner that they interact with each other. A preferred embodiment of the two layers provided in association with each other is such that the non-light sensitive layer containing substantially non-light sensitive fine silver halide grains is disposed adjacent to the emulsion layer containing a mobile dye forming coupler and in a place farther away from the support.

The silver halide emulsion layer according to the present invention may be of a unit structure consisting of two or three emulsion layers which are sensitive to light of substantially the same color but which have different sensitivities. This unit has in association therewith at least one non-light sensitive layer defined above, as well as other photographically functional auxiliary layers. A preferred layer arrangement of the unit of emulsion layers is such that a layer having higher sensitivity is positioned farther away from the support. According to the present invention, the mobile dye forming coupler is preferably incorporated in the emulsion having the highest sensitivity in the unit, with the non-sensitive layer defined above being positioned adjacent to that emulsion layer and in a place farther from the support. The silver halide emulsion layer used in the present invention may consist of several units of emulsion layers, with every two units having sensitivity to light of different colors. In this case, a unit having sensitivity to light of a shorter wavelength is preferably disposed farther from the support.

While various layer arrangements may be employed depending upon the specific object and use of the silver halide photographic material, a typical example is a combination of a unit composed of two blue-sensitive emulsion layers, one having a higher sensitivity than the other, a non-sensitive layer and any other auxiliary layer, a unit consisting of a highly green-sensitive emulsion layer and a highly red-sensitive emulsion layer, and a unit consisting of green- and red-sensitive emulsion layers, both having a lower sensitivity than those making up the second unit.

For the purpose of preventing retarded development in a color photographic material using two or more silver halide emulsion layers having sensitivity to light of different colors, it is preferred that the mobile dye forming coupler according to the present invention is incorporated in at least that emulsion layer which is positioned closest to the support while the non-light sensitive layer defined above is disposed in association with that emulsion layer.

The mobile dye forming coupler according to the present invention is represented by the following formula (I):

$$\begin{array}{l} \text{COUP—adjusting group.} \\ \quad\;\; | \\ \text{stabilizing group} \end{array} \qquad \text{(I)}$$

In formula (I), COUP represents the nucleus of the coupler that forms a dye, and the stabilizing group is one which is bound to the coupling site on the nucleus and which leaves COUP upon coupling reaction between the coupler and the oxidized product of a color developing agent. The stabilizing group has a sufficient molecular size and shape to render the coupler nondiffusible. The adjusting group is bound to a non-coupling site with respect to COUP and has a size and shape sufficient to impart mobility to the dye formed by the coupling reaction between the coupler and the oxidized product of a color developing agent.

The coupler nucleus represented by COUP may be selected from among any compounds that are commonly used in the art to form dyes upon coupling reaction with the oxidized product of a color developing agent. Illustrative yellow dye forming couplers are acyl acetanilides and benzoyl acetanilides. Illustrative magenta dye forming couplers are pyrazolones, pyrazolotriazoles, pyrazolobenzimidazoles and indazolones. Illustrative cyan dye forming couplers are phenols and naphthols.

The stabilizing group in formula (I) has a size and shape sufficient to impart mobility to the coupler. Useful stabilizing groups include alkyl, aryl and heterocyclic moieties having rot less than 8 carbon atoms, preferably 8 to 32 carbon atoms. These stabilizing groups may have substituents that will change the reactivity of the coupler, such as halogen atoms, nitro, cyano, alkoxy, aryloxy, carboxy, alkoxycarbonyl, sulfo, sulfamoyl, carbamoyl, acylamino, diacylamino, ureido, urethane, sulfonamido, hetero ring, arylsulfonyl, alkylsulfonyl, arylthio, alkylthio, alkylamino, hydroxy, alkyl and aryl. These stabilizing groups may have a cross-linking group that binds them to the coupling site on the coupler nucleus. Typical cross-linking groups include —O—, —S—, —N=N— and

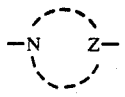

(wherein Z is an atomic group necessary to form a 5- to 7-membered hetero ring). Preferred stabilizing groups with such cross-linking groups include alkoxy, aryloxy, heterocyclic oxy, alkylthio, arylthio, heterocyclic thio and nitrogen-containing hetero rings having 8 to 32 carbon atoms.

The stabilizing group preferably has the additional ability to release a photographically useful group a predetermined time after it leaves the coupler upon its coupling reaction with the oxidized product of a color developing agent. The stabilizing group may render the coupler nondiffusible by forming a polymer which binds to the coupling site on the coupler nucleus with the aid of a suitable cross-linking group described above.

The adjusting group in formula (I) has a sufficient size and shape to impart mobility to the dye produced by coupling reaction with a color developing agent. For a given adjusting group, the mobility of the dye formed varies with the type of the coupler nucleus to which the adjusting group is bonded, the type of substituents introduced into the coupler nucleus, and the type of color developing agent that couples with the coupler to form the dye. Any adjusting group may be used so long as it imparts the desired mobility to the dye. Preferred adjusting groups include an alkyl group, a cyclocyclic alkyl group, aryl groups having 6 to 20 carbon atoms and a heterocyclic group. These groups may be substituted by groups that affect the spectral characteristics and mobility of the dye. The adjusting group may contain a basic ionizable group such as hydroxy, carboxy, sulfo or aminosulfonyl, or an ionizable salt thereof, which imparts mobility to otherwise nondiffusible dyes. These basic ionizable groups may be present in the form of their precursors, which, upon hydrolysis or intramolecular nucleophilic substitution reaction during development, forms a basic ionizable group that imparts mobility to otherwise nondiffusible dyes.

These adjusting groups may have a cross-linking group that assists its binding to the coupler nucleus. Illustrative cross-linking groups used for this purpose include —O—, —S—, —CO—, —COO—, —NR—, —CONR—, —NRCO—, —$SO_2$NR—, —NR$SO_2$—, and —NRCONR— (wherein R is a hydrogen atom, an alkyl group or an aryl group).

Preferred couplers capable of producing yellow mobile dyes are represented by the following formula (II):

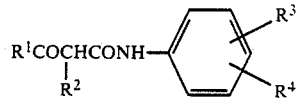

(II)

wherein $R^1$ is an aryl group (e.g. phenyl) or an alkyl group (e.g. tertiary alkyl group such as t-butyl group); $R^2$ is the stabilizing group defined above; $R^3$ is the adjusting group defined in formula (I) including, for example, hydrogen and halogen atoms and calboxy hydroxy, nitro, cyano, alkyl, alkoxy, aryloxy, sulfonamido, acylamino, carbamoyl, sulfamoyl, alkoxycarbonyl, aryloxycarbonyl, acyloxy, sulfonoxy, ureido and alkylsulfonyl groups; and $R^4$ is a hydrogen atom, a halogen atom, an alkyl group, an alkoxy group, a sulfamoyl group or the adjusting group defined in formula (I) as exemplified in $R^3$ above. Particularly preferred examples of the stabilizing group bound to these couplers by a cross-linking group are aryloxy, heterocyclic oxy and nitrogen-containing hetero rings.

Preferred examples of the coupler that forms a mobile cyan dye are represented by the following formulas (III) and (IV):

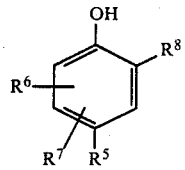

(III)

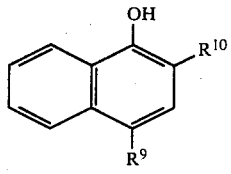

(IV)

wherein $R^5$ has the same meaning as $R^2$ in formula (II); one of $R^6$, $R^7$ and $R^8$ is the adjusting group defined in formula (I) including, for example, hydrogen and halogen atoms and alkyl, alkoxy, acylamino, sulfonamido and ureido groups, and the other two groups which may be the same or different represent a hydrogen atom, a halogen atom, an alkyl group, an alkoxy group or an alkylamido group; $R^9$ has the same meaning as $R^5$; and $R^{10}$ is the adjusting group, for example, a carbamoyl group. Particularly preferred examples of the stabilizing group bonded to the coupler nucleus by a cross-linking group include alkyloxy, aryloxy, heterocyclic oxy and arylazo.

Preferred couplers that form mobile magenta dyes are represented by the following formulas (V), (VI) and (VII):

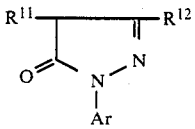

(V)

-continued (VI)

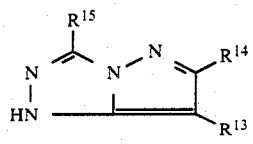

(VII)

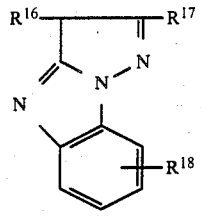

wherein $R^{11}$ has the same meaning as $R^5$ in formula (III); $R^{12}$ is the adjusting group including, for example, alkyl, acylamino, anilino, ureido and pyrolidynyl groups; Ar is a phenyl group which may have a substituent selected from among a halogen atom, an alkyl group, an alkoxy group, an amino group and a sulfo group, said phenyl group optionally having the adjusting group defined above; $R^{13}$ has the same meaning as $R^{11}$; one of $R^{14}$ and $R^{15}$ is the adjusting group including, for example, a halogen atom and alkyl, alkoxy, aryl, acylamino, alkylthio, amino, alkylcarbamoyl and aralkyl groups, the other one being a hydrogen atom, an alkyl group, an alkoxy group, an aryl group, an amino group or an acylamino group; $R^{16}$ has the same meaning as $R^{11}$; one of $R^{17}$ and $R^{18}$ is the adjusting group as exemplified $R^{12}$ above, and the other is a hydrogen atom, an alkyl group, an alkoxy group, an aryl group, an amino group, an acylamino group or a ureido group.

Particularly preferred examples of the stabilizing group that is bonded to the coupler nucleus by a cross-linking group are aryloxy, alkylthio, arylthio, heterocyclic thio and arylazo.

The non-diffusible couplers shown above which form a mobile dye upon coupling with the oxidized product of a color developing agent are preferably incorporated in at least the emulsion layer having the highest sensitivity in a unit of emulsion layers which are sensitive to light of substantially the same color but which have different sensitivities. For example, if the unit consists of a bottommost emulsion layer of low sensitivity, an overlying emulsion layer of medium sensitivity, and a topmost layer of high sensitivity, the non-diffusible coupler is preferably incorporated in at least the emulsion layer of high sensitivity.

These couplers are preferably incorporated in the emulsion layer of high sensitivity in an amount of 0.01–0.03 mol/mol of silver, and in an emulsion layer of low sensitivity in an amount of 0.05–0.15 mol/mol of silver. The couplers may be used in combination with a suitable DIR compound which is preferably used in an amount of 0.0005–0.08 mol/mol of silver.

Typical examples of the non-diffusible coupler shown above which forms a mobile dye upon coupling reaction with the oxidized product of a color developing agent are listed below, but it should be understood that the scope of the present invention is by no means limited to these examples.

(Y-1)

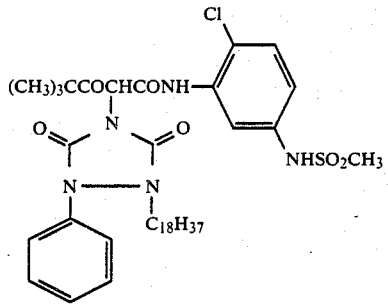

(Y-2)

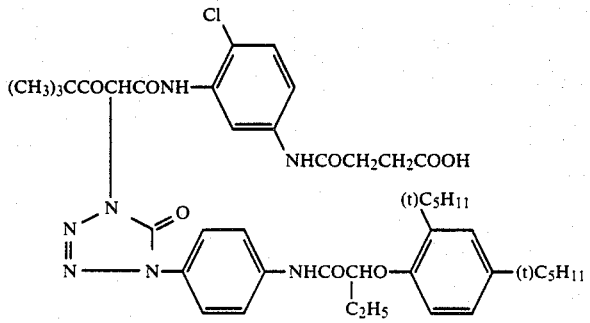

-continued
(Y-3)
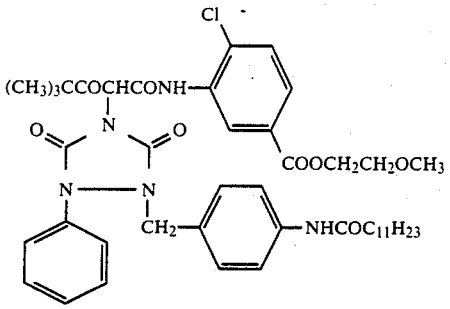
(Y-4)
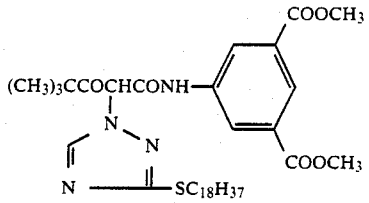
(Y-5)
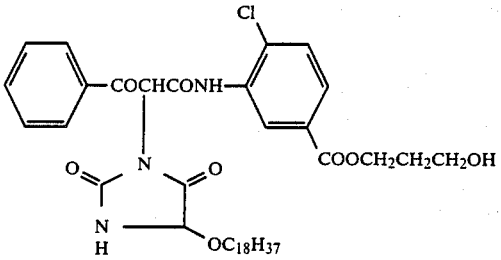
(Y-6)
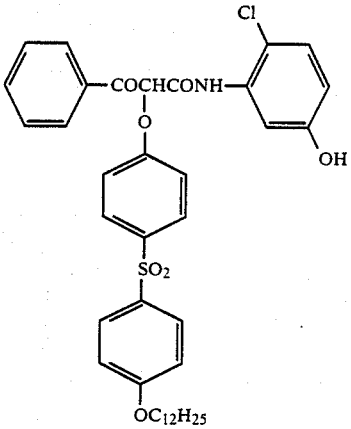
(Y-7)
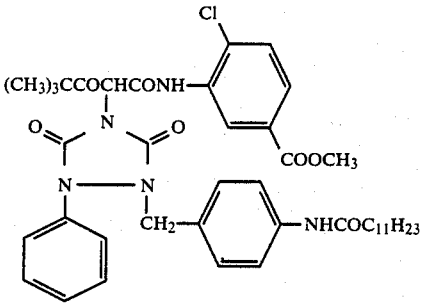
(Y-8)
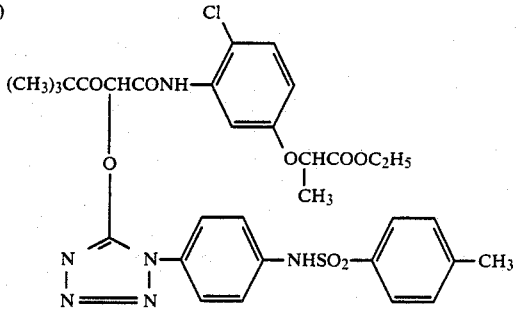
(Y-9)
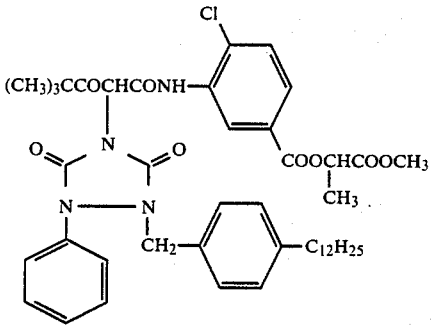
(Y-10)
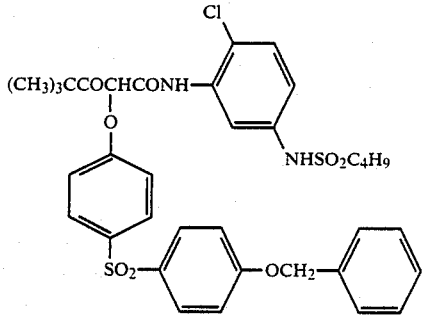
(Y-11)
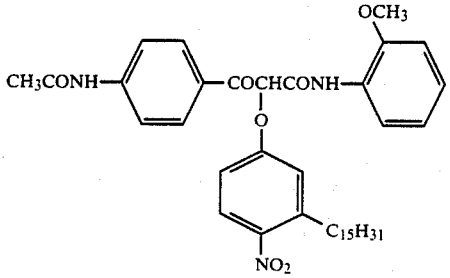
(Y-12)
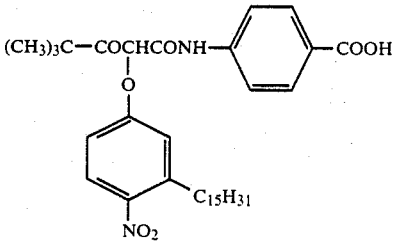

-continued
(Y-13)
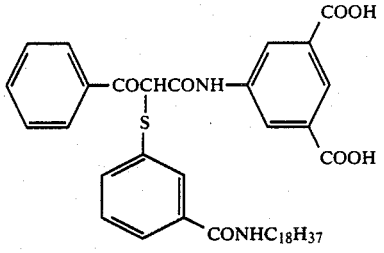
(Y-14)
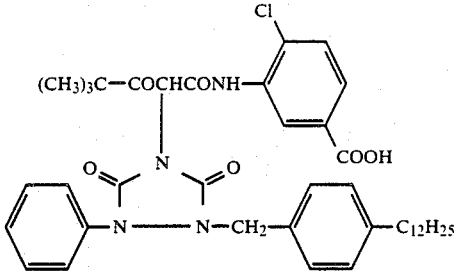
(Y-15)
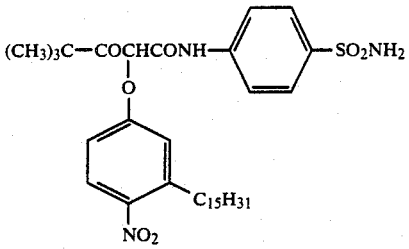
(M-1)
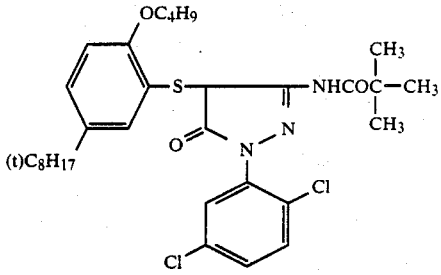
(M-2)
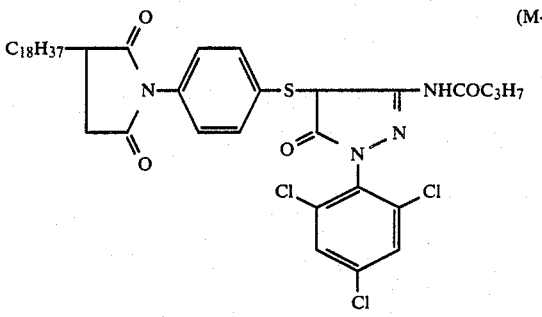
(M-3)
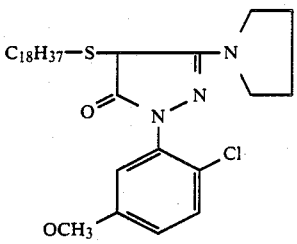
(M-4)
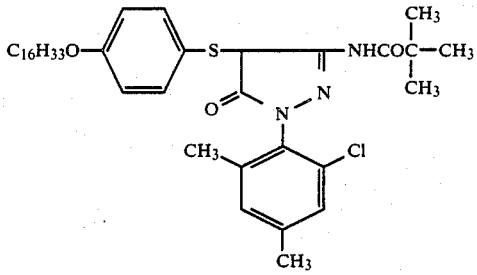
(M-5)
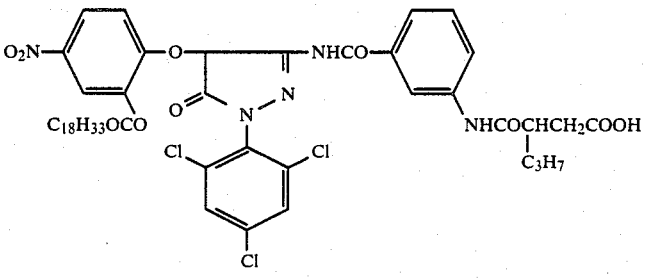

-continued
(M-6)
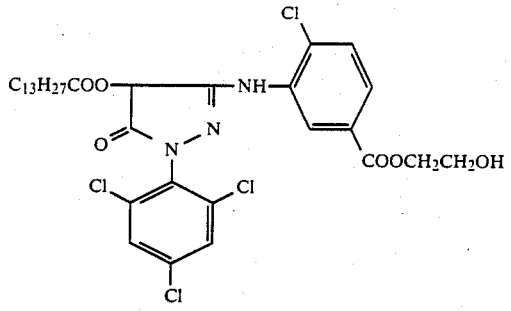
(M-7)
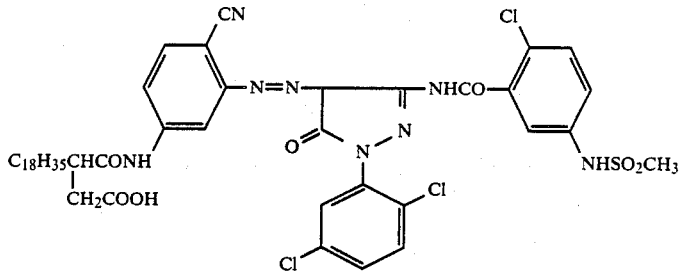
(M-8)
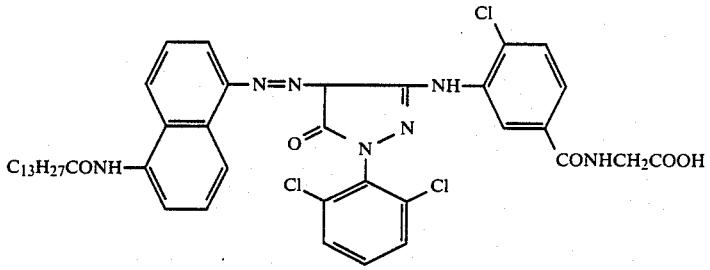
(M-9)
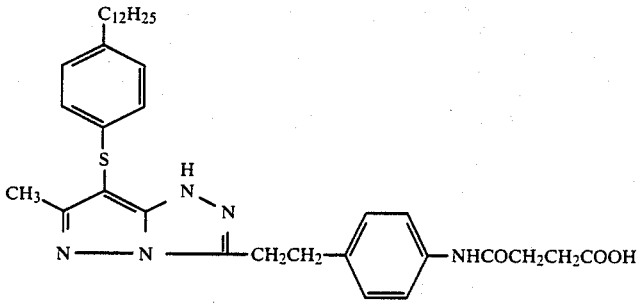
(M-10)
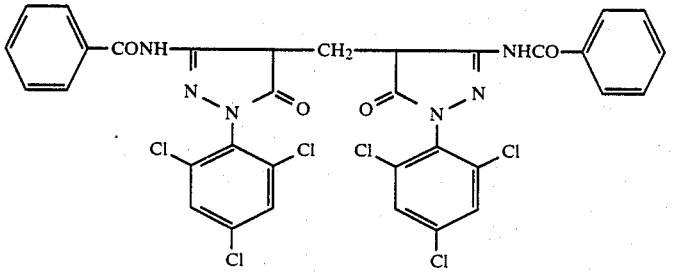

-continued
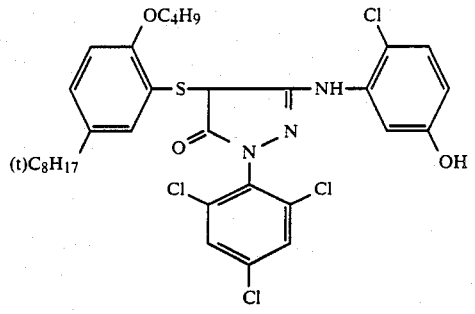
(M-11)
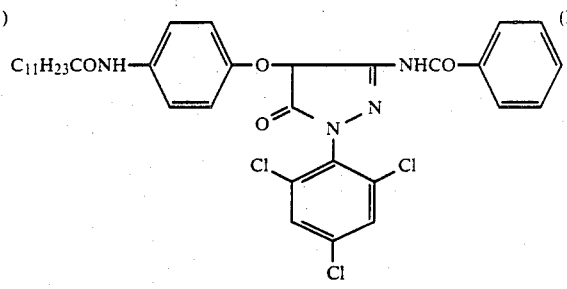
(M-12)
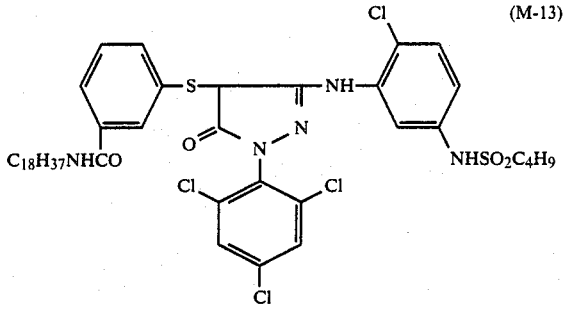
(M-13)
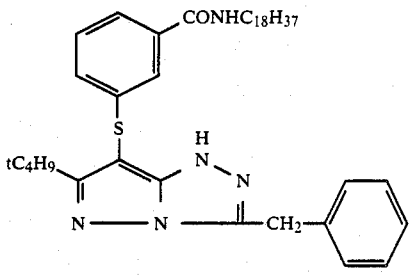
(M-14)
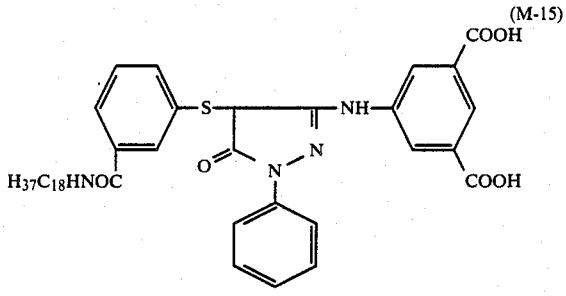
(M-15)
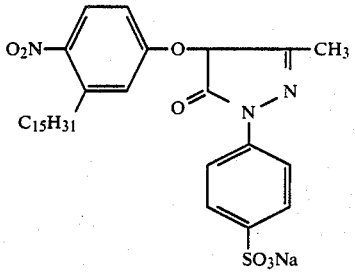
(M-16)
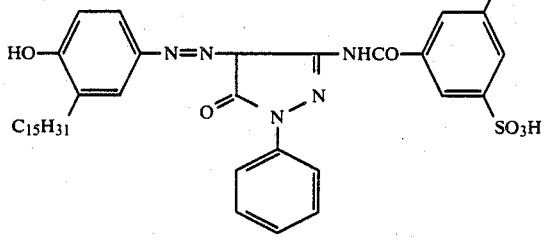
(M-17)
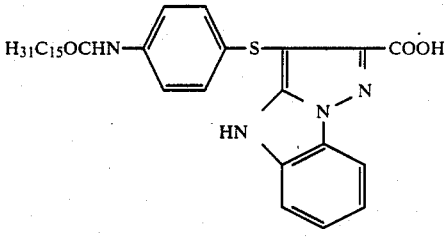
(M-18)
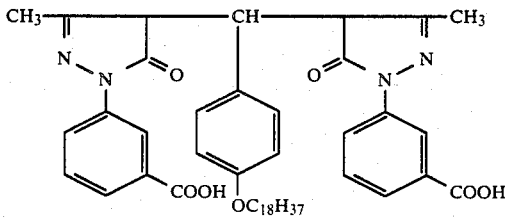
(M-19)

-continued
(M-20)
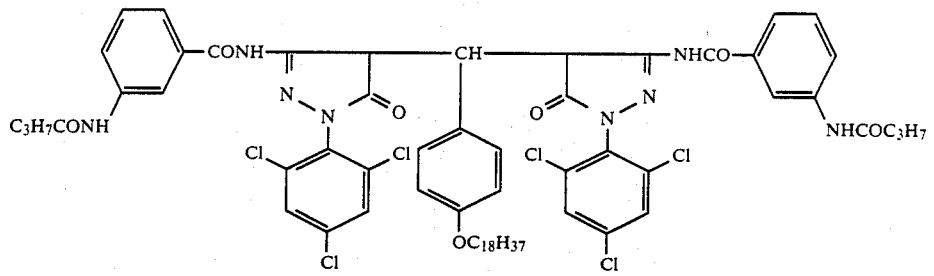
(M-21)
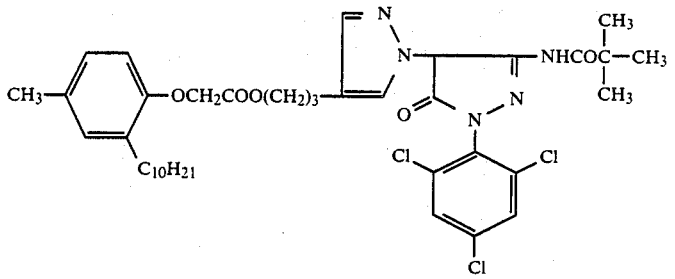
(C-1)
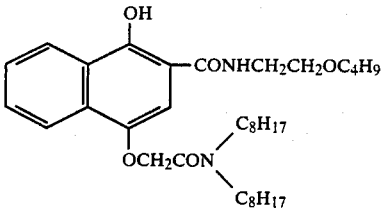
(C-2)
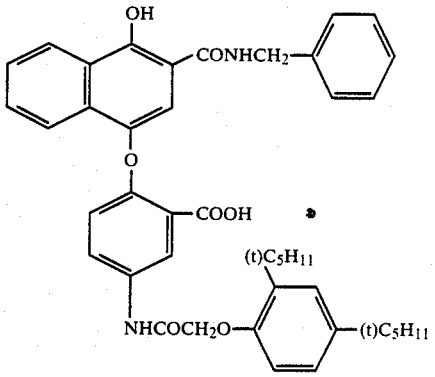
(C-3)
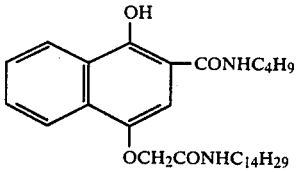
(C-4)
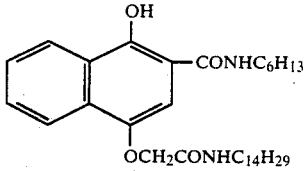
(C-5)
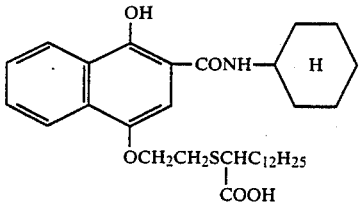
(C-6)
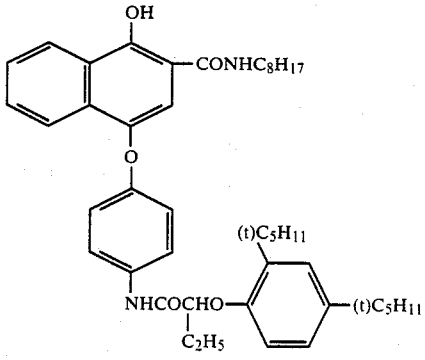

-continued
(C-7)
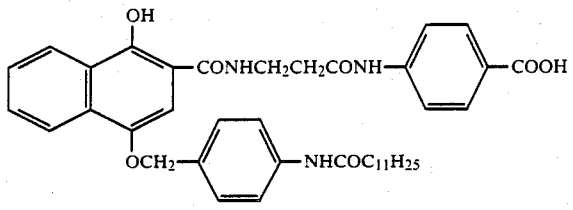
(C-8)
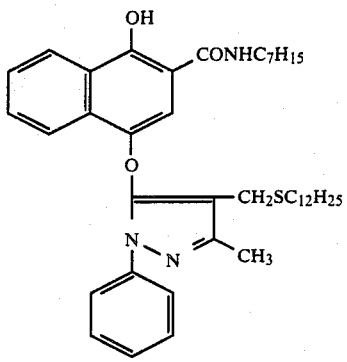
(C-9)
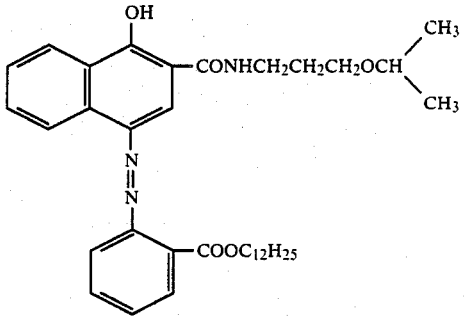
(C-10)
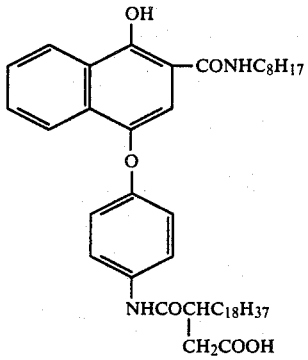
(C-11)
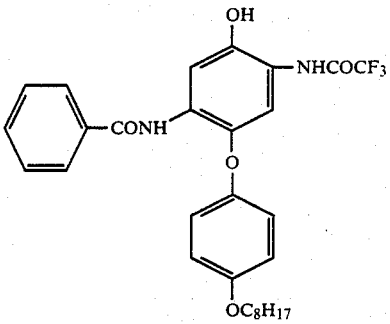
(C-12)
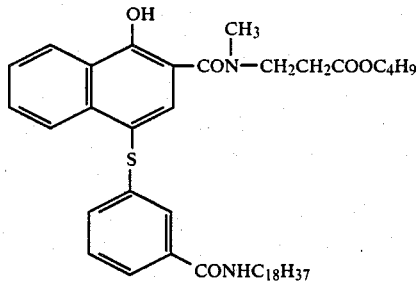
(C-13)
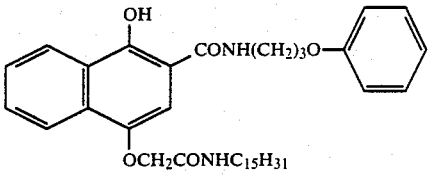
(C-14)
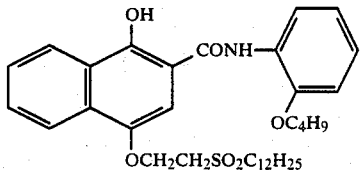
(C-15)
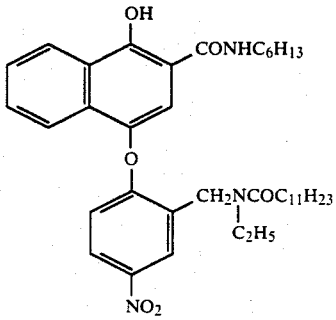

-continued (C-16)

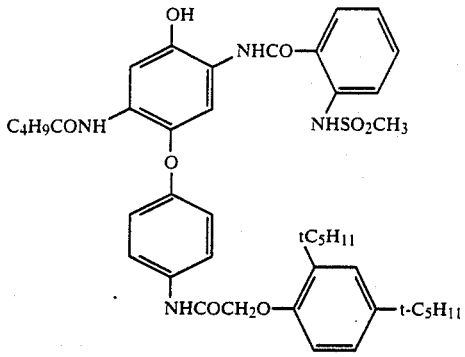

(C-17)

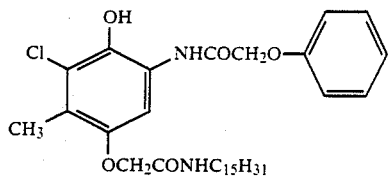

(C-18)

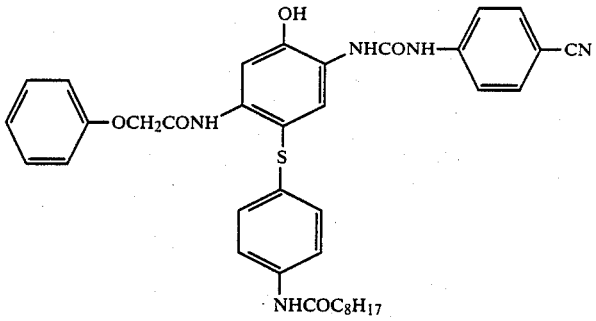

(C-19)

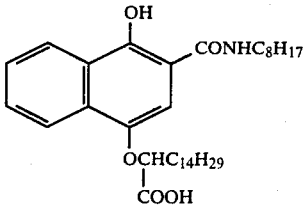

(C-20)

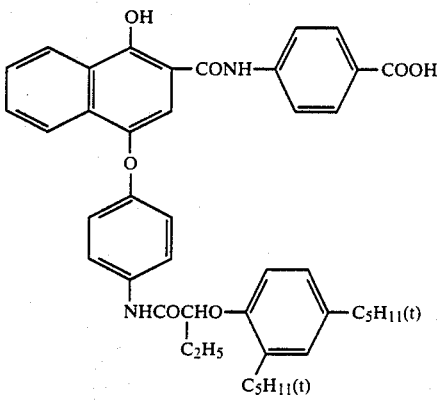

(C-21)

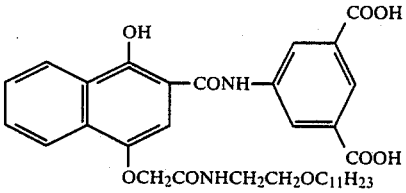

(C-22)

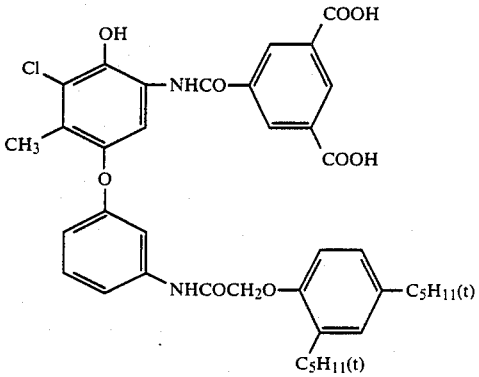

The silver halide emulsion layers according to the present invention may contain photographic couplers other than the mobile dye forming couplers shown above. Preferred photographic cyan couplers are phenolic and naphtholic compounds, which may be selected from among those shown in U.S. Pat. Nos. 2,369,929, 2,434,272, 2,474,293, 2,895,826, 3,253,924, 3,034,892, 3,311,476, 3,386,301, 3,419,390, 3,458,315, 3,476,563 and 3,591,383. These references also list the methods of synthesis of the compounds shown above.

Illustrative photographic magenta couplers include pyrazolones, pyrazolotriazoles, pyrazolinobenzimidazoles and indazolones. Pyrazolone magenta couplers that may be advantageously used in the present invention are shown in U.S. Pat. Nos. 2,600,788, 3,062,653, 3,127,269, 3,311,476, 3,419,391, 3,519,429, 3,558,318, 3,684,514, and 3,888,680; Japanese Patent Public Disclosure Nos. 29639/1974, 111631/1974, 129538/1974, and 13041/1975, Japanese Patent Publication Nos. 10491/1979, 47167/1978 and 30615/1980. Suitable pyrazolotriazole magenta couplers are shown in U.S. Pat. No. 1,247,493 and Belgian Pat. No. 792,525. Useful pyrazolinobenzimidazole magenta couplers are listed in U.S. Pat. No. 3,061,432, German Pat. No. 2,156,111 and Japanese Patent Publication No. 60479/1971. Advantageous indazolone magenta couplers are recited in Belgian Pat. No. 769,116.

Known open-chain ketomethylene compounds may be used as photographic yellow couplers in the present invention, and typical examples are commonly used benzoylacetanilide yellow couplers and pivaloyl yellow couplers. Other usable couplers are two-equivalent yellow couplers wherein the carbon atom at coupling site is substituted by a group that are capable of leaving the coupler upon coupling reaction with the oxidized product of a color developing agent. For more details of these yellow couplers and methods of their synthesis, see U.S. Pat. Nos. 2,875,057, 3,265,506, 3,664,841, 3,408,194, 3,447,928, 3,277,155, and 3,415,652; Japanese Patent Publication No. 13576/1974; Japanese Patent Public Disclosure Nos. 29432/1973, 66834/1973, 10736/1974, 122335/1974, 28834/1975 and 132926/1975.

The non-diffusible couplers shown above may be dispersed by various methods such as dispersion in aqueous alkali solutions, solids, latices and in oil-in-water type emulsions. A suitable method should be selected depending upon the chemical structure of the specific coupler.

The non-sensitive layer according to the present invention which contains substantially non-light sensitive fine silver halide grains includes one or more hydrophilic colloidal layers, and at least one of these hydrophilic colloidal layers has dispersed therein substantially non-sensitive silver halide grains.

The non-sensitive fine silver halide grains may be of any type that is substantially non-light sensitive or which is substantially insensitive to a developing solution. Preferred grains are those which are substantially incapable of development and dissolution in a developer. As for their average size, grains not larger than 0.3 μm are preferred, and in order to prevent decreased acuity due to light scattering, the range of 0.02 to 0.2 μm is more preferred. The grain size distribution may be wide or narrow, but a narrow distribution is preferred.

The substantially non-sensitive fine silver halide grains may have any composition such as silver chloride, silver bromide, silver iodide, silver iodobromide, silver chlorobromide, or silver chloroiodobromide. Two or more halide compositions may be used in combination. From a solubility viewpoint, silver halide containing silver bromide is preferred, and silver iodobromide containing less than 10 mol % of silver iodide is particularly preferred. The non-sensitive fine silver halide grains used in the present invention may be physically ripened by rhodanide ions, cyano ions or thiocyanate ions, or etched with a suitable silver halide solvent. These silver halide grains may be prepared by the neutral method, half ammoniacal method or ammoniacal method. The double-jet method or conversion method may be employed depending on the need. Silver halide in the non-sensitive layer is generally deposited in an amount of 0.01–1 g/m$^2$ in terms of silver (Ag), preferably in an amount of 0.1–0.5 g/m$^2$. The non-sensitive layer may contain various additives such as a matting agent (e.g. colloidal silica or polymethyl methacrylate), a high-boiling solvent (e.g. tricresyl phosphate or dioctyl phthalate), a UV absorber, an antioxidant, an oleophilic component (e.g. hydroquinone derivative), a coating aid (e.g. surfactant) and gelatin hardener.

Gelatin is a typical binder suitable for use in the non-sensitive layer. Part or all of the gelatin may be replaced by colloidal albumin, agar, gum arabic, alginic acid, or a cellulose derivative such as hydrolyzed cellulose acetate, carboxymethyl cellulose, hydroxyethyl cellulose, or methyl cellulose. Synthetic binders may also be used, and suitable examples are poly (vinyl alcohol), partially saponified poly(vinyl alcohol), polyacrylamide, poly-N,N-dimethylacrylamide, poly-N-vinylpyrrolidone; water-soluble polymers as shown in U.S. Pat. Nos. 3,847,620, 3,655,389, 3,341,332, 3,615,424 and 3,860,428; gelatin derivatives such as phenylcarbamylated gelatin, acylated gelatin and phthalated gelatin of the type shown in U.S. Pat. Nos. 2,614,928 and 2,525,753; as well as copolymers of the type shown in U.S. Pat. Nos. 2,548,520 and 2,831,767 which have grafted to gelatin a monomer having a polymerizable ethylene group such as acrylic acid (or its ester), methacrylic acid (or its ester) or acrylonitrile.

Any of the common silver halide emulsions may be used in the photographic material of the present invention, and they may comprise individual crystals of silver chloride, silver bromide, silver iodobromide, silver chlorobromide, silver chloroiodide or silver chloroiodobromide, or mixtures of their crystals. The silver halide emulsion may be comprised of either large or small grains and may consist of a monodisperse or polydisperse system. The crystals of silver halide grains may be cubic, octahedral or epitaxial mixed crystals. The emulsion may be negative or direct positive. A latent image may be formed principally on the surface of silver halide grains, or within such grains. If desired, two different types of emulsions may be employed.

The silver halide emulsion used in the present invention maybe prepared by any conventional method, as well as by any known method. One example is the conversion method which is shown in Japanese Patent Publication No. 7772/1971; an emulsion of silver salt grains at least part of which is composed of a silver salt having a higher solubility than silver bromide is prepared, and then, at least part of these grains are converted to silver bromide or silver iodide. Another usable method is similar to what is conventionally used to prepare a Lippmann emulsion comprising fine silver halide grains of an average size of not more than 0.1 μm.

In order to prepare a high-sensitivity silver halide emulsion, silver iodobromide containing 1–10 mol % of silver iodide is preferably used, and a grain size of 0.5–3.0 μm is preferred. Silver iodobromide containing 1–10 mol % of silver iodide is also preferably used in preparing a low-sensitivity emulsion, but the preferred grain size is 0.1–0.8 μm.

As already mentioned, the light-sensitive layer according to the present invention may comprise two or three silver halide emulsion layers which are sensitive to light of substantially the same color but which have different sensitivities. The difference in sensitivity between two such emulsion layers (ΔlogE) is generally in the range of 0.1–1.0, preferably 0.2–0.6.

If two or more emulsion layers are formed on a support, a layer farther from the support limits the amount of light received by an underlying layer, and as a result, the closer to the support an emulsion layer is, the smaller the amount of light to which it is exposed. Therefore, the emulsion layers used in the present invention preferably contain emulsions comprising monodisperse silver halide grains having low optical loss. For this purpose, at least 50% of the silver halide grains is preferably made of monodisperse grains. More preferably, 70% of the silver halide grains is composed of monodisperse grains, and most desirably, all grains in each emulsion are monodisperse. The monodisperse grains may be formed by mixing two or more groups of grains having different average sizes.

For the purposes of the present invention, silver halide grains are defined as monodisperse if the standard deviation of their grain size (S) divided by the average size ($\bar{r}$) is 0.17 or less, as shown by the following inequality (A):

$$\frac{S}{\bar{r}} \leqq 0.17 \qquad \text{(A)}$$

wherein $$S = \sqrt{\frac{\Sigma(\bar{r} - ri)^2 ni}{\Sigma ni}}.$$

The average grain size ($\bar{r}$) is the average of the diameters of spherical silver halide grains, or the average of the diameters of circles having the same area as that of the projected image of cubic or non-spherical grains. The average grain size is defined by:

$$\bar{r} = \frac{\Sigma ni\, ri}{\Sigma ni}$$

wherein $r_i$ is the representative grain size for each of the subgroups of the population under observation, and $n_i$ is the number of the grains in a subgroup.

Various methods are available for determining the size of the silver halide grains incorporated in the emulsion layers of the present invention. Two typical methods are Loveland's "Grain Size Analysis Method" reported in A.S.T.M. Symposium on Light Microscopy, 1955, pp. 94–122, and the method described in Chapter 2 of "The Theory of the Photographic Process", C. E. Kenneth and T. H. James, 3rd ed. The Macmillan Company, 1966. The projected area or approximated diameter of grains is an effective tool for size determination. If the grains are of a substantially uniform shape, their size distribution can be expressed fairly accurately in terms of their diameter or projected area.

The grain size distribution can be determined by the method described in the article of Trivelli and Smith reported in "Empirical Relation between the Sensitometric Distribution and Size Distribution in Photographic Emulsions", The Photographic Journal, LXXIX, (1949), pp. 330–338.

The monodisperse silver halide grains according to the present invention may be prepared by the double-jet method wherein grains of the desired size are made through the proper control over pAg and pH. Highly monodisperse silver halide emulsions may be prepared by the method shown in Japanese Patent Public Disclosure No. 48521/1979. In a preferred embodiment, potassium iodobromide, as well as aqueous solutions of gelatin and ammoniacal silver nitrate are added to an aqueous gelatin solution containing silver halide seeds, with the amount of addition being varied according to the specific emulsion to be prepared. Highly monodisperse silver halide grains may be obtained by properly controlling the time function of the addition rate, pH, pAg, temperature and humidity.

For the purposes of the present invention, the monodisperse silver halide grains may be made of silver bromide, silver iodide, silver iodobromide and silver chloroiodobromide. So long as they are monodisperse, these grains may assume any crystallographic form such as hexahedron, octahedron or fourteen-sided polyhedron, with the hexahedral and fourteen-sided forms being particularly preferred. The monodisperse silver halide grains used in the present invention may have a uniform composition of silver halide, but preferably, they are made of a core-shell structure having different silver halide compositions.

The monodisperse, core-shell type silver halide grains preferably used in the present invention each consist of a core made of silver halide substantially containing silver iodide, and a surrounding shell made of silver bromide, silver chloride, silver iodobromide or silver chlorobromide. The content of silver iodide in the shell is preferably lower than in the core. The lower the silver iodide content of the shell, the better; most preferably, the shell is substantially made of silver bromide, with the silver iodide content being approximately zero. The core may consist of two or more layers having different silver iodide contents. The difference in silver iodide content between two layers may be sharp or diffuse.

The distribution of silver halide in the core-shell type silver halide grains may be determined by various physical methods. In one method, this is done by measuring luminescence at low temperatures, as shown in the Proceedings of 1981 Annual Meeting of the Society of Photographic Science and Technology of Japan.

The thickness of the shell is preferably in the range of 0.001–0.1 μm, more preferably between 0.01 and 0.1 μm.

In a preferred embodiment of the monodisperse, core-shell type silver halide grains, the core consists of silver halide containing 2–15 mol % of silver iodide and the shell consists of silver halide containing 0–4 mol % of silver iodide. The rest of the silver halide composition is preferably silver bromide, but silver chloride may be present in an amount that is not deleterious to the purposes of the present invention.

Two or more types of core-shell silver halide grains having different average silver iodide contents may be preferably used in the present invention. The preferred content of silver iodide in the silver halide grains used in the present invention ranges from 0.5–15 mol %. A more preferred range is from 1 to 5 mol %.

The silver halide emulsion containing the core-shell silver halide grains may be prepared by forming a shell around a core made of a monodisperse silver halide grain. The core-forming monodisperse silver halide grains may be prepared by the method shown above for preparing the monodisperse grains of non-core-shell type.

The shell must be thin enough not to mask the desired properties of the core but must be thick enough to conceal the unwanted properties of the core. A shell having the proper thickness may be prepared by the double-jet method, wherein a solution of soluble halide and a solution of soluble silver salt are applied to deposit a desired silver halide on core- forming, monodisperse silver halide grains. For further details of the method of preparing the core-shell type silver halide grains, see German patent No. 1,169,290, British patent No. 1,027,146, Japanese Patent Public Disclosure No. 154232/1982 and Japanese Patent Publication No. 1417/1976.

The silver halide emulsion used in the present invention may be doped with various metal salts or complex salts during the precipitation of silver halide grains, or during or after the growth of grains. Suitable salt or complex forming metals that may be used for this purpose are gold, platinum, palladium, iridium, rhodium, bismuth, cadmium and copper, as well as mixtures thereof. Desalting may be performed by any of the methods commonly used in the manufacture of emulsions, such as noodle washing, dialysis or dialytic precipitation.

The silver halide emulsion used in the present invention may be chemically sensitized by a sulfur sensitizer (e.g. allyl thiocarbamide, thiourea or cystine); an active or inactive selenium sensitizer; a reduction sensitizer (e.g. stannous salts or polyamine); or a noble metal sensitizer such as a gold sensitizer (e.g. potassium auritiocyanate, potassium chloroaurate, or 2-aurosulfobenzottiazol methochloride) or a water-soluble salt of ruthenium, rhodium or iridium (e.g. ammonium chloropalladate, potassium chloroplatinate or sodium chloropalladide). Some of these compounds may work either as a sensitizer or an anti-foggant depending on the amount in which they are used. These sensitizers may be used either alone or in combination (e.g. a gold sensitizer may be used in combination with a sulfur sensitizer or a selenium sensitizer).

The silver halide used in the present invention may also be sensitized to a desired spectrum of wavelengths. For this purpose, spectral sensitizers such as cyanine dyes (e.g. zero-methine dyes, monomethine dyes, dimethine dyes and trimethine dyes) and merocyanine dyes may be used alone, or in combination to achieve hypersensitization.

Examples of the hydrophilic colloid that may be used with the light-sensitive silver halide emulsion according to the present invention include not only gelatin but also any hydrophilic colloid that is used as the binder for the non-sensitive layer shown above. These hydrophilic colloids may be used either alone or in combination.

The emulsion according to the present invention may contain various photographic additives depending upon the specific object. They include stabilizers or anti-foggants such as azaindenes, triazoles, tetrazoles, imidazolium salts, tetrazolium salts and polyhydroxy compounds; hardeners such as aldehydes, aziridines, isoxazoles, vinylsulfones, acryloyls, carbodiimides, maleimides, methanesulfonic acid esters and triazines; development accelerators such as benzyl alcohol and polyoxyethylene compounds; image stabilizers such as chromans, couramanes, bisphenols, and phosphite esters; and lubricants such as wax, glyceride of higher aliphatic acids and higher alcohol esters of higher aliphatic acids. Surfactants may be used as coating aids, agents to modify the penetrability of processing solutions, defoaming agents or for the purpose of controlling various physical properties of the light-sensitive material; suitable surfactants may be cationic, anionic, nonionic or ampoteric. Antistats may also be used and they include diacetyl cellulose, styrene-perfluoroalkyl sodium maleate copolymer, and alkali salts of the reaction product of styrene-maleic anhydride copolymer and p-aminobenzenesulfonic acid. Matting agents may also be incorporated in the emulsion, and suitable examples are poly(methylmethacrylate), polystyrene and alkali-soluble polymers. Colloidal silicon oxide is also usable. Latices may be added to provide good film properties, and suitable examples are copolymers of acrylate esters or vinyl esters with other monomers containing an ethylene group. Other usable additives include gelatin plasticizers such as glycerine or glycolic compounds, and thickeners such as styrene-sodium maleate copolymer and alkylvinyl ether-maleic acid copolymer.

The support used in the present invention may be made of various materials such as baryta paper, polyethylene coated paper, synthetic polypropylene paper, glass, cellulose acetate, cellulose nitrate, polyvinyl acetal, polypropylene, polyester (e.g. polyethylene tetraphthalate) film and polystyrene. Suitable materials may be selected depending upon the specific use of the photographic material. The support used in the present invention may be subbed as required.

The respective layers that make up the photosensitive material of the present invention may be applied to the support by various methods such as immersion coating, air knife coating, curtain coating, or extrusion coating using a hopper of the type shown in U.S. Pat. No. 2,681,294. If desired, two or more layers may be simultaneously applied by one of the methods shown in U.S. Pat. No. 2,761,791 and British patent No. 837,095.

The silver halide photographic material of the present invention can be processed by any known processing method. For example, the material may be processed typically by a process comprizing color development; thereafter bleach-fixing, then, if necessary, washing and stabilization, or a process comprising color development, thereafter, bleaching, then fixing, and, if necessary, washing and stabilization.

EXAMPLE

The present invention is hereunder described in greater detail by reference to working examples, to which the scope of the present invention is by no means limited. Many other various modifications may be made to the following examples.

In these examples, the improvement in image sharpness was evaluated in terms of relative MTF (modulation transfer function) values for 30 lines/mm, with the value for a comparative sample being taken as 100. The improvement in image granularity was evaluated in terms of relative standard deviation (RMS or root mean square) values of variations in the density of images (initial densities: fog+0.3 and fog+1.0, as scanned by a microdensitometer with a circular scanning aperture of 25 $\mu$m) times 1,000. As in the evaluation of the improvement in image sharpness, the improvement in image granularity was evaluated in relative values, with the value for a control sample taken as 100.

The couplers, DIR compound and anti-stain agent used in the examples are identified below.

(Y'-1)
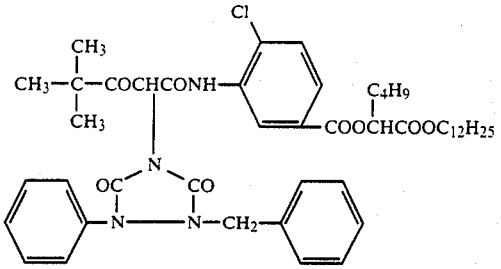
(Y-1)
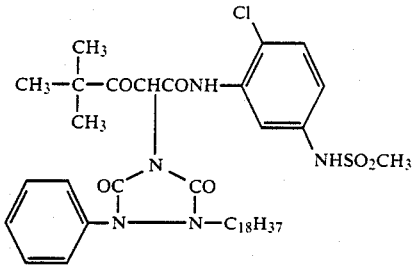
(M'-1)
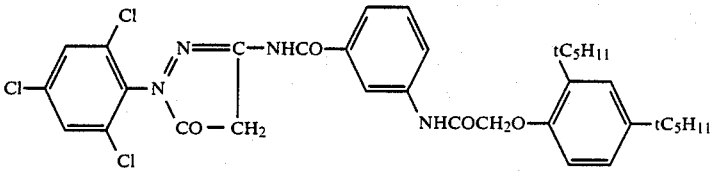
(M-4)
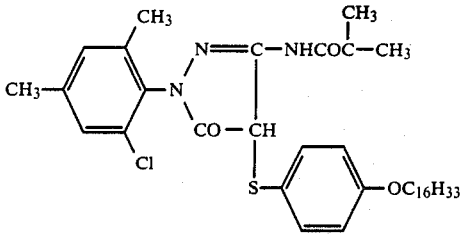
(C'-1)
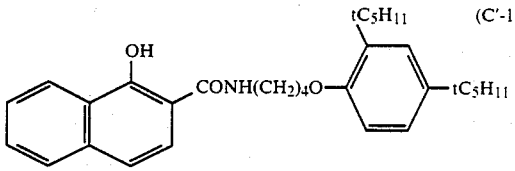
(C-4)
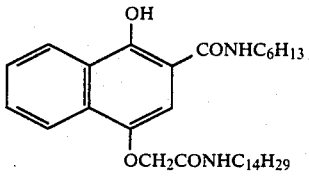
(CM-1)
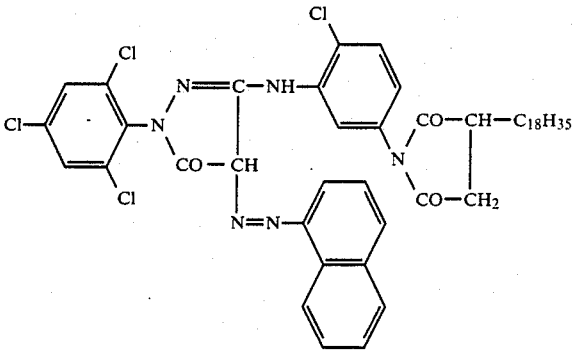
(CC-1)
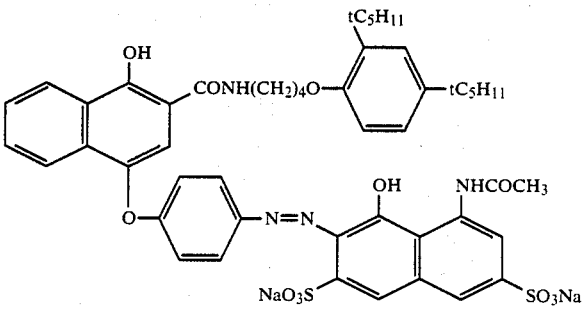

-continued (D-1)

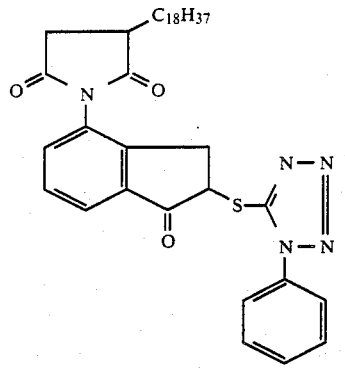

(HQ-1)

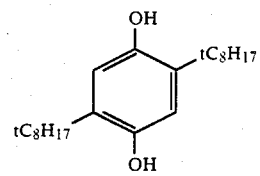

EXAMPLE 1

Preparation of polydisperse emulsions

Aqueous solutions of silver nitrate and alkali halide were dropped by gravity into a reactor (60° C.) which contained an aqueous gelatin solution and excess halide. Then, an aqueous solution of "Demor N" (product of Kao-Atlas Company, Ltd.) and an aqueous solution of magnesium sulfate were added to cause precipitation and desalting. Upon addition of gelatin, an emulsion of pAg 7.8 and pH 6.0 was obtained. This emulsion was chemically ripened with sodium thiosulfate, chloroauric acid and ammonium rhodanide. Upon addition of 4-hydroxy-6-methyl-1,3,3a,7-tetrazaindene, 6-nitrobenzimidazole and gelatin, a polydisperse silver bromide emulsion was obtained. The concentration (mol %) of silver iodide in this polydisperse emulsion was varied by changing the composition of alkali halide. The average grain size and size distribution of the same emulsion were varied by changing the timing of addition of aqueous solutions of silver nitrate and alkali halide.

The width of the size distribution of individual grains as represented by the coefficient of variation (CV) was 27–32%. The coefficient of variation is given by:

$$CV(\%) = \frac{S}{r} \times 100.$$

Preparation of photosensitive materials

Transparent supports made of a subbed cellulose triacetate film were successively coated with the layers shown below, thereby preparing samples 1 to 5. In the Examples shown below, the values of the amounts of ingredients incorporated in the silver halide color photographic material are based on one square meter, and the amounts of silver halide emulsions and colloidal silver are shown in terms of silver.

Sample 1

Layer 1: Anti-halation layer containing 0.3 g of black colloidal silver and 2 g of gelatin;

Layer 2: Highly red-sensitive silver iodobromide emulsion layer containing 1.5 g of silver iodobromide (average grain size: 1.2 μ, silver iodide content: 8 mol %), 1.5 g of gelatin and 0.25 g of tricresyl phosphate (TcP) having 0.13 g of cyan coupler (C'-1) and 0.03 g of colored cyan coupler (CC-1) dissolved therein;

Layer 3: Intermediate layer containing 1.0 g of gelatin;

Layer 4: Highly green-sensitive silver iodobromide emulsion layer containing 1.5 g of silver iodobromide (average grain size: 1.2 μ, silver iodide content: 8 mol %) 1.5 g of gelatin and 0.3 g of TcP having 0.17 g of magenta coupler (M'-1) and 0.03 g of colored magenta coupler (CM-1) dissolved therein; and Layer 5: Protective layer containing 1.5 g of gelatin.

Sample 2 was prepared and its composition was the same as that of Sample 1 except for layer 3. Samples 3 to 5 were prepared as above except for layers 2 and 3. Only the modified layers are shown below.

Sample 2

Layer 3: Intermediate silver halide layer containing 0.3 g of non-sensitive silver iodobromide grains with an average size of 0.1 μ (4 mol % silver iodide) and 1.0 g of gelatin Sample 3

Layer 2: Highly red-sensitive silver iodobromide emulsion layer containing 0.15 g of cyan coupler (C-4) instead of 0.13 g of cyan coupler (C'-1);

Layer 3: Intermediate silver halide layer containing 0.3 g of non-sensitive silver iodobromide grains average size, 0.4 μm; silver iodide content, 4 mol %) and 0.1 g of gelatin Sample 4

Layer 2: Highly red-sensitive silver iodobromide emulsion layer as used in Sample 3;

Layer 3: Intermediate silver halide layer containing 2.0 g of non-sensitive silver iodobromide grains (average size, 0.1 μ; silver iodide content, 4 mol %) and 1.0 g of gelatin Sample 5

Layer 2: Highly red-sensitive silver iodobromide emulsion layer as used in Sample 3;

Layer 3: Intermediate silver halide layer as used in Sample 2.

The respective samples were placed in intimate contact with either an optical wedge or a transparent rectangular wave chart depending on the case, exposed to a light source having no blue light, and processed according to the following scheme so as to obtain dye images.

| Processing scheme (38° C.) | Time |
|---|---|
| Color development | 3 min and 15 sec |
| Bleaching | 6 min and 30 sec |
| Water rinsing | 3 min and 15 sec |
| Fixing | 6 min and 30 sec |
| Water rinsing | 3 min and 15 sec |
| Stabilization | 1 min and 30 sec |

In the respective steps, the folowing solutions were used.

| Components | Amount (g) |
|---|---|
| Color developer | |
| 4-Amino-3-methyl-N—ethyl-N—(β-hydroxyethyl)-aniline sulfate | 4.75 |
| Anhydrous sodium sulfite | 4.25 |
| Hydroxylamine hemisulfate | 2.0 |
| Anhydrous potassium carbonate | 37.5 |
| Sodium bromide | 1.3 |
| Trisodium nitrilotriacetate (monohydrate) | 2.5 |
| Potassium hydroxide | 1.0 |
| Water to make | 1000.0 ml |
| pH | 10.0 |
| Bleaching solution | |
| Ethylenediaminetetraacetic acid iron ammonium salt | 100.0 |
| Ethylenediaminetetraacetic acid diammonium salt | 10.0 |
| Ammonium bromide | 150.0 |
| Glacial acetic acid | 10.0 |
| Water to make | 1000.0 ml |
| pH | 6.0 |

| Components | Amount (ml) |
|---|---|
| Fixing solution | |
| Ammonium thiosulfate (50% aq. sol.) | 162 |
| Anhydrous sodium sulfite | 12.4 |
| Water to make | 1000.0 |
| pH | 6.5 |
| Stabilizing bath | |
| Formalin (37% aq. sol.) | 5.0 |
| Konidax (Konishiroku Photo Industry Co., Ltd.) | 7.5 |
| Water to make | 1000.0 |

The cyan images formed on the samples processed as above were checked for their sensitivity, fog, RMS values and MTF values, and the results are shown in Table 1. The sensitivity values shown in Table 1 are relative ones, with the value for sample 1 taken as 100.

TABLE 1

| Sample No. | Fog | Sensitivity | RMS values (fog + 0.3) | MTF values (30 lines/mm) |
|---|---|---|---|---|
| 1 (Comparative sample) | 0.10 | 100 | 30 | 100 |
| 2 (Comparative sample) | 0.11 | 120 | 33 | 100 |
| 3 (Comparative sample) | 0.11 | 105 | 28 | 80 |
| 4 (Comparative sample) | 0.13 | 150 | 27 | 95 |
| 5 (Sample of the present invention) | 0.10 | 180 | 22 | 100 |

As Table 1 shows, sample No. 5 of the present invention had improved sensitivity and granularity without sacrificing the image acuity or experiencing increased fog.

EXAMPLE 2

Samples 6 to 9 were prepared by successively forming the following layers on transparent supports made of a subbed cellulose triacetate film.

Sample 6

Layer 1: Anti-halation layer as used in Sample 1;

Layer 2: Highly green-sensitive silver iodobromide exmulsion layer containing 1.5 g of silver iodobromide (average grain size: 1.2 μ, silver iodide content: 8 mol %), 1.5 g of gelatin, and 0.3 g of TcP having 0.16 g of magenta coupler (M-4) and 0.03 g of colored magenta coupler (CM-1) dissolved therein;

Layer 3: Intermediate layer as used in Sample 1;

Layer 4: Yellow filter layer containing 0.1 g of yellow colloidal silver, 0.06 g of dioctyl phthalate (DoP) having 0.1 g of anti-stain agent (HQ-1) dissolved therein, and 1.5 g of gelatin;

Layer 5: Highly blue-sensitive silver iodobromide emulsion layer containing 1.0 g of silver iodobromide (average grain size: 1.2 μ, silver iodide content: 8 mol %), 1.0 g of gelatin, and 0.06 g of TcP having 0.3 g of yellow coupler (Y'-1) dissolved therein; and Layer 6: Protective layer containing 1.5 g of gelatin.

Sample 7

The same as Sample 6 except that layer 3 was replaced by the intermediate silver halide emulsion layer used in Sample 5.

Sample 8

Layer 1: Anti-halation layer as used in Sample 1;

Layer 2: Highly blue-sensitive silver iodobromide emulsion layer which was the same as layer 5 in Sample 6 except that 0.3 g of yellow coupler (Y'-1) was replaced by 0.27 g of yellow coupler (Y-1);

Layer 3 Protective layer containing 1.5 g of gelatin.

Sample 9

This sample was the same as Sample 8 except that layer 3 was replaced by the intermediate silver halide layer as used in Sample 5.

Samples 6 to 9 thus prepared were placed in contact with an optical wedge, exposed to white light, and processed as in Example 1, thereby producing dye images. The samples were checked for the sensitivity of their respective image forming layers (magenta image forming layer for samples 6 and 7, and yellow image forming layer for samples 8 and 9), fog and RMS values. Samples 7 and 9 according to the present invention had improved sensitivity and granularity.

EXAMPLE 3

Preparation of monodisperse core-shell type emulsion

An aqueous solution of ammoniacal silver nitrate and an aqueous solution of potassium iodide and potassium bromide were added to a reactor at controlled pAg and pH which had been charged with silver halide seed grains and an aqueous solution of gelatin. The amounts of the aqueous solution of ammoniacal silver nitrate and that of potassium iodide and potassium bromide were increased as the silver halide grains (core) grew to increase their surface area. For further details of the procedure of shell formation, see Japanese Patent Public Disclosure No. 48521/1979. To the so prepared core-shell grains, an aqueous solution of "Demor N" (product of Kao-Atlas Company, Ltd.) and an aqueous solution of magnesium sulfate were added to cause precipitation and desalting. Upon addition of gelatin, an emulsion of pAg 7.8 and pH 6.0 was obtained. This emulsion was chemically ripened with sodium thiosulfate, chloroauric acid and ammonium rhodanide. Upon addition of 4-hydroxy-6-Methyl-1,3,3a,7-tetrazaindene, 6-nitrobenzimidazole and gelatin, a monodisperse silver iodobromide emulsion was obtained. The concentration (mol %) of silver iodide in this monodisperse emulsion was varied by changing the ratio of potassium iodide to potassium bromide. The grain size of the emulsion was varied by changing the amounts of ammoniacal silver nitrate and potassium halides added.

The grains in the emulsions had a silver bromide shell thickness ranging from 0.01 to 0.02 μm, and the width of their size distribution was 11–13%.

Preparation of photosensitive materials

Samples 10 to 17 were prepared by forming successively the following layers on transparent supports made of a subbed cellulose triacetate film. Samples 10 to 14 used a polydisperse emulsion, whereas Samples 15 and 16 used a monodisperse core-shell type emulsion.

Sample 10

Layer 1: Anti-halation layer as used in Sample 1;

Layer 2: Silver iodobromide emulsion layer of low red sensitivity containing 1.5 g of silver iodobromide (average grain size: 0.6 μ, silver iodide content: 7 mol %), as well as 1.5 g of gelatin, and 0.6 g of TcP having 0.7 g of cyan coupler (C'-1), 0.07 g of colored cyan coupler (CC-1) and 0.02 g of DIR compound (D-1) dissolved therein;

Layer 3: Highly red-sensitive silver iodobromide emulsion layer as used in Sample 1;

Layer 4: Intermediate silver halide layer as used in Sample 5;

Layer 5: Silver iodobromide emulsion layer of low green sensitivity containing 1.5 g of silver iodobromide (average grain size: 0.6 μ, silver iodide content: 7 mol %), as well as 1.5 g of gelatin and 0.95 g of TcP having 0.8 g of magenta coupler (M'-1), 0.15 g of colored magenta coupler (CM-1) and 0.02 g of DIR compound (D-1) dissolved therein;

Layer 6: Highly green-sensitive silver iodobromide emulsion layer as used in Sample 1; and Layer 7: Protective layer containing 1.5 g of gelatin.

Samples 11 to 17 were prepared as above except that layers 2 and 3 were modified as follows.

Sample 11

Layer 2: Silver iodobromide emulsion layer of low red sensitivity as in Sample 10 except that 0.7 g of cyan coupler (C'-1) was replaced by 0.79 g of a different cyan coupler (C-4);

Layer 3: Highly red-sensitive silver iodobromide emulsion layer as in Sample 10.

Sample 12

Layer 2: Silver iodobromide emulsion layer of low red sensitivity as in Sample 10;

Layer 3: Highly red-sensitive silver iodobromide emulsion layer as in Sample 5.

Sample 13

Layer 2: Silver iodobromide emulsion layer of low red sensitivity as in Sample 11;

Layer 3: Highly red-sensitive silver iodobromide emulsion layer as in Sample 12.

Sample 14

Layer 2: Silver iodobromide emulsion layer of low red sensitivity as in Sample 13 except that the content of silver iodide was 4 mol % rather than 7 mol %;

Layer 3: Highly red-sensitive silver iodobromide emulsion layer as in Sample 13 except that the content of silver iodide was 4 mol % rather than 8 mol %.

Sample 15

Layer 2: Silver iodobromide emulsion layer of low red sensitivity as in Sample 13 except that the polydisperse emulsion was replaced by a monodisperse core-shell type emulsion;

Layer 3: Highly red-sensitive silver iodobromide emulsion layer as in Sample 13 except that the polydisperse emulsion was replaced by a monodisperse core-shell type emulsion.

Sample 16

Layer 2: Silver iodobromide emulsion layer of low red sensitivity as in Sample 15 except that the content of silver iodide was 4 mol % rather than 7 mol %;

Layer 3: Highly red-sensitive silver iodobromide emulsion layer as in Sample 15 except that the content of silver iodide was 4 mol % rather than 8 mol %.

The samples so prepared were placed in contact with an optical wedge or a transparent rectangular wave chart, exposed to a light source having no blue light, and processed as in Example 1 to produce cyan dye images.

The images formed were checked for their sensitivity, fog, RMS vlaues, and MTF values (only for samples 13 to 16), and the results are shown in Table 2. Sensitivity values shown in Table 2 are relative ones, with the value for sample 10 taken as 100.

TABLE 2

| Sample No. | Fog | Sensitivity | RMS Values fog + 0.3 | RMS Values fog + 1.0 | MTF Values 30 lines/mm |
|---|---|---|---|---|---|
| 10 (Comparative sample) | 0.10 | 100 | 35 | 32 | — |
| 11 (Sample of the present invention) | 0.10 | 130 | 34 | 26 | — |
| 12 (Sample of the present invention) | 0.10 | 170 | 26 | 28 | — |
| 13 (Sample of the present invention) | 0.10 | 170 | 26 | 26 | 100 |
| 14 (Sample of the present invention) | 0.10 | 170 | 25 | 25 | 100 |
| 15 (Sample of the present invention) | 0.10 | 180 | 26 | 25 | 120 |
| 16 (Sample of the present invention) | 0.10 | 180 | 24 | 24 | 120 |

As the above data shows, the granularity can be improved by incorporating a mobile dye forming coupler in at least a high-sensitivity eumulsion layer. Particularly good sensitivity and sharpeness are obtained by using a monodisperse core-shell type emulsion. Aignificant improvement in image quality is achieved by using a silver iodobromide emulsion of low silver iodide content as that monodisperse core-shell type emulsion.

EXAMPLE 4

Samples 17 to 19 (multi-layered silver halide color photographic material) were prepared by successively forming the following layers on transparent supports made of a subbed cellulose triacetate film.

Sample 17

Layer 1: Anti-halation layer as in Sample 1;

Layer 2: Silver iodobromide emulsion layer of low red sensitivity as in Sample 10;

Layer 3: Highly red-sensitive silver iodobromide emulsion layer as in Sample 10;

Layer 4: Intermediate silver halide layer as in Sample 5;

Layer 5: Silver iodobromide emulsion layer of low green sensitivity as in Sample 10;

Layer 6: Highly green-sensitive silver iodobromide emulsion layer as in Sample 10;

Layer 7: Yellow filter layer as in Sample 6;

Layer 8: Silver iodobromide emulsion layer of low blue sensitivity containing 0.5 g of silver iodobromide (average grain size: 0.6 μ, silver iodide content: 7 mol %), 1.0 g of gelatin, and 0.3 g of TcP having 1.5 g of yellow coupler (Y'-1) dissolved therein;

Layer 9: Highly blue-sensitive silver iodobromide emulsion layer as in Sample 6; and Layer 10: Protective layer containing 1.5 g of gelatin.

Samples 18 and 19 were prepared as above except that red-sensitive layers 2 and 3 were modified as follows. In Sample 19, layers 5 to 11 corresponded respectively to layers 4 to 10 in Sample 17.

Sample 18

Layer 2: Silver iodobromide emulsion layer of low red sensitivity as in Sample 10 except that the polydisperse silver iodobromide emulsion with 7 mol % silver iodide was replaced by a monodisperse core-shell type emulsion containing 4 mol % silver iodide:

Layer 3: Highly red-sensitive silver iodobromide emulsion layer as in Sample 16.

Sample 19

Layer 2: Silver iodobromide emulsion layer of low red sensitivity as in Sample 18;

Layer 3: Silver iodobromide emulsion layer of medium red sensitivity containing 1.5 g of monodisperse core-shell type silver iodobromide grains (average size: 0.8 μm, silver iodide content: 4 mol %), 1.5 g of gelatin and 0.2 g of TcP having 0.15 g of cyan coupler (C'-1) and 0.05 g of colored cyan coupler (CC-1) dissolved therein;

Layer 4: Highly red-sensitive silver iodobromide emulsion layer as in Sample 16.

The samples so prepared were placed in contact with an optical wedge or a rectangular wave chart, exposed to white light, and processed as in Example 1 in order to provide cyan dye images. The images were checked for their sensitivity, RMS values and MFT values, the results of which are shown in Table 3. The sensitivity data in Table 3 are expressed in relative values with the value for Sample 17 taken as 100.

TABLE 3

| Sample No. | Sensitivity | RMS values fog + 0.3 | RMS values fog + 1.0 | MTF values 30 lines/mm |
|---|---|---|---|---|
| 17 (comparative sample) | 100 | 35 | 32 | 100 |
| 18 (Sample of the present invention) | 180 | 24 | 24 | 120 |
| 19 (Sample of the present invention) | 190 | 23 | 21 | 120 |

As the above data shows, the silver halide color photographic material according to the present invention retained the advantages obtained in Examples 1 to 3 (high sensitivity and image quality) even when it was composed of a multi-layer arrangement. A particularly great improvement in image quality was achieved by using a red-sensitive layer unit composed of three sublayers.

In summary, the present invention has the following six advantages.

(1) It provides a color photographic material having high sensitivity and good granularity.

(2) A mobile coupler provides a better granularity than the conventional non-diffusible coupler. However, by combining the mobile coupler with the non-sensitive layer containing fine silver halide grains according to the present invention, the decrease in sensitivity due to the interlayer effect is prevented (which is substantially equal to sensitization), and quite unexpectedly, a significant improvement in granularity is also achieved. This is probably because the developability of silver halide is improved (which leads to increased color density) and the spread of dye is increased. It should be emphasized that the increase in granularity without causing a sensitivity loss can only be accomplished by combining the mobile coupler with the non-sensitive layer containing fine silver halide grains specified in the present invention.

(3) Using a silver iodobromide emulsion layer with low silver iodide content (e.g. 4 mol %) is effective not only in decreasing the number of "dead" grains but also in improving the developability of silver halide grains and the granularity of image.

(4) Using a monodisperse core-shell type emulsion is effective in improving the granularity, especially image acuity.

(5) Significant advantages are obtained by combining a high-sensitivity panchromatic layer (this is highly susceptible to the interlayer effect) containing a mobile coupler with an overlying non-sensitive layer containing fine silver halide grains. Particularly good results are attained by using a three-layered panchromatic emulsion unit.

(6) The presence of the layer containing fine silver halide grains is responsible for highly stable development.

What is claimed is:

1. A silver halide photographic material having formed on a support at least one unit structure consisting of two or more silver halide emulsion layers which are sensitive to light of substantially the same color but which have different sensitivities, one of said silver halide emulsion layers having a highest sensitivity containing a coupler which forms a mobile dye by coupling reaction with an oxidized product of a color developing agent and said silver halide emulsion layer with said highest sensitivity having in association therewith a non-light-sensitive layer containing substantially non-light-sensitive fine silver halide grains, said non-light-sensitive layer adjoining said silver halide emulsion layer with said highest sensitivity, said silver halide emulsion layer with said highest sensitivity being positioned furthest from said support in said unit.

2. A silver halide photographic material according to claim 1, wherein said coupler is represented by the following formula (I):

$$\begin{array}{l}\text{COUP—adjusting group}\\ \quad\;\;|\\ \text{Stabilizing group}\end{array} \qquad \text{(I)}$$

wherein COUP represents the coupler nucleus which forms a dye; the stabilizing group is a group which is bound to the coupling site on said nucleus and which is split off therefrom upon coupling reaction between said coupler and the oxidized product of a color developing agent, said stabilizing group having a sufficient molecular size and shape to render said coupler nondiffusible; and the adjusting group is a group which is bound to a non-coupling site with respect to said necleus and which has a size and shape sufficient to impart mobility to the dye formed by the coupling reaction between said coupler and said oxidized product.

3. A silver halide photographic material according to claim 2, wherein the adjusting group in said formula (I) is a group having 1 to 20 carbon atoms.

4. A silver halide photographic material according to claim 2, wherein the stabilizing group in said formula (I) is a group having 8 to 32 carbon atoms.

5. A silver halide photographic material according to claim 4, wherein said stabilizing group is an alkyl or phenyl group.

6. A silver halide photographic material according to claim 2, wherein said coupler represented by formula (I) is a coupler represented by the following formula (II):

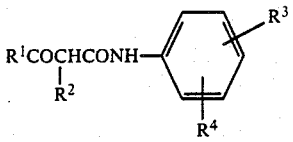

(II)

wherein $R^1$ is an aryl or alkyl group; $R^2$ is the stabilizing group defined in formula (I); $R^3$ is the adjusting group defined in formula (I); and $R^4$ is a hydrogen or halogen atom, an alkyl, alkoxy or sulfamoyl group or the adjusting group defined in formula (I).

7. A silver halide photographic material according to claim 2, wherein said coupler represented by formula (I) is a coupler represented by the following formula (III) cr (IV):

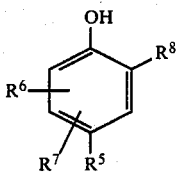

(III)

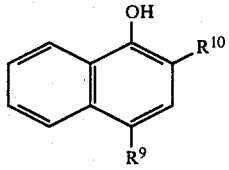

(IV)

wherein $R^5$ is the stabilizing group defined in formula (I); $R^6$, $R^7$ and $R^8$ each represents a hydrogen or halogen atom, an alkyl, alkoxy or alklamido group or the adjusting group defined in formula (I), provided that one of $R^6$, $R^7$, and $R^8$ is the adjusting group defined in formula (I); $R^9$ has the same meaning as $R^5$; and $R^{10}$ is the adjusting group defined in formula (I).

8. A silver halide photographic material according to claim 2, wherein said coupler represented by formula (I) is a coupler represented by the following formula (V), (VI) or (VII):

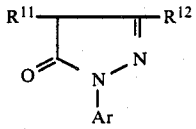

(V)

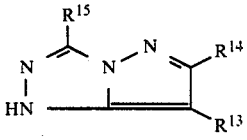

(VI)

-continued

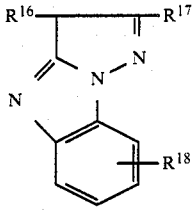

(VII)

wherein $R^{11}$ is the stabilizing group defined in formula (I); $R^{12}$ is the adjusting group defined in formula (I); Ar is a pheny group; $R^{13}$ has the same meaning as $R^{11}$; $R^{14}$ and $R^{15}$ each is a hydrogen atom, an alkyl, alkoxy, aryl, amino or acylamino group or the adjusting group defined in formula (I), provided that either $R^{14}$ or $R^{15}$ is the adjusting group defined in Formula (I); $R^{16}$ has the same meaning as $R^{11}$; either $R^{17}$ or $R^{18}$ is the adjusting group defined in formula (I), the other one being a hydrogen atom or an alkyl, alkoxy, aryl, amino, acylamino or ureido group.

9. A silver halide photographic material according to claim 6, wherein the adjusing group represented by $R^3$ and $R^4$ in said formula (II) is a group selected from the group consisting of hydrogen and halogen atoms and carboxy hydroxy, nitro, cyano, alkyl, alkoxy, aryloxy, sulfonamido, acylamino, carbamoyl, sulfamoyl, alkoxycarbonyl, aryloxycarbonyl, acyloxy, sulfonoxy, ureido and alkylsulfonyl groups.

10. A silver halide photographic material according to claim 7, wherein the adjusting group represented by $R^6$, $R^7$ and $R^8$ in said formula (III) is a group selected from the group consisting of hydrogen and halogen atoms and alkyl, alkoxy, acylamino, sulfonamido and ureido groups.

11. A silver halide photographic material according to claim 7, wherein the adjusting group represented by $R^{10}$ in said formula (IV) is a carbamoyl group.

12. A silver halide photographic material according to claim 8, wherein the adjusting group represented by $R^{12}$ in said formula (V) and by $R^{17}$ and $R^{18}$ in said formula (VII) is a group selected from the group consisting of alkyl, acylamino, anilino, ureido and pyrolidinyl groups.

13. A silver halide photographic material according to claim 8, wherein the adjusting group represented by $R^{14}$ and $R^{15}$ in said formula (VI) is a group selected from the group consisting of a halogen atom and alkyl, alkoxy, aryl, acylamino, alkylthio, amino, alkylcarbamoyl and aralkyl groups.

14. A silver halide photographic material according to claim 1, wherein said coupler is a nondiffusible coupler.

15. A silver halide photographic material according claim 1, wherein said coupler is incorporated in the emulsion layer having the highest sensitivity in an amount of 0.01 to 0.2 mol/mol of silver.

16. A silver halide photographic material according to claim 1, wherein said fine silver halide grains have an average grain size of 0.02 to 0.2 $\mu$.

17. A silver halide photographic material according to claim 1, wherein said fine silver halide grains are incorporated in the non-light sensitive layer in an amount of 0.01 to 1 g/m$^2$ in terms of silver (Ag).

18. A silver halide photographic material according to claim 1 wherein said unit structure consists of three silver halide emulsion layers.

19. A silver halide photographic material according to claim 1 wherein said silver halide emulsion layers are panchromatically sensitized.

20. A method of forming color negative images by imagewise exposing a silver halide phtographic material and then processing the exposed material with a color developer, said material having formed on a support at least one unit structure comprising two silver halide emulsion layers which are sensitive to light of substantially the same color but which have different sensitivites, one of said silver halide emulsion layers having a highest sensitivity containing a coupler which forms a mobile dye by coupling reaction with an oxidized product of a color developing agent, and said silver halide emulsion layer with the highest sensitivity having in association therewith a non-light-sensitive layer containing substantially non-light-sensitive fine silver halide grains, said non-light-sensitive layer being positioned adjacent to said silver halide emulsion layer having the highest sensitivity in the unit and in a place furthest from said support.

21. A method of forming color negative images according to claim 20, wherein said coupler is represented by formula (II):

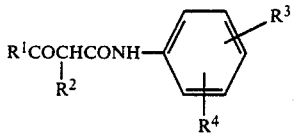

(II)

wherein $R^1$ is an aryl or alkyl group; $R^2$ is a stabilizing group which is bound to the coupling site on said nucleus and which is split off therefrom upon coupling reaction between said coupler and the oxidized product of a color developing agent, said stabilizing group having a sufficient molecular size and shape to render said coupler non-diffusible; $R^3$ is an adjusting group which is bound to a non-coupling site with respect to said nucleous and which has a size and shape sufficient to impart mobility to the dye formed by the coupling reaction between said coupler and said oxidized product; and $R^4$ is a hydrogen, halogen, alkyl, alkoxy, or sulfamoyl or said adjusting group.

22. A method of forming color negative images according to claim 20, wherein said coupler is represented by formulas (III) or (IV):

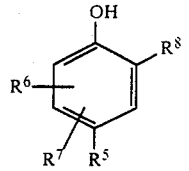

(III)

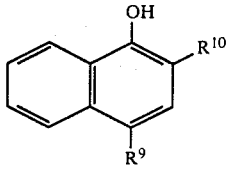

(IV)

wherein $R^5$ is said stabilizing group; $R^6$, $R^7$ and $R^8$ each represents hydrogen, halogen, alkyl, alkoxy, alkylamido or said adjusting group; provided that at least one of $R^6$, $R^7$ and $R^8$ is said adjusting group; $R^9$ has the same meaning as $R^5$; and $R^{10}$ is said adjusting group.

23. A method of forming color negative images according to claim 20, wherein said silver halide emulsion is a core-shell type emulsion.

24. A method of forming color negative images according to claim 20 wherein said unit structure consists of three silver halide emulsion layers.

25. A silver halide photographic material having formed on a support at least one unit structure consisting of two or more silver halide emulsion layers which are sensitive to light of substantially the same color but which have different sensitivities, one of said silver halide emulsion layers having a highest sensitivity containing a coupler which forms a mobile dye by coupling reaction with an oxidized product of a color developing agent and said silver halide emulsion layer with said highest sensitivity having in association therewith a non-light-sensitive layer containing substantially non-light-sensitive fine silver halide grains and being positioned farther away from the support in said unit, said non-light-sensitive layer adjoining said silver halide emulsion layer with said highest sensitivity, said non-light-sensitive layer being positioned furthest from said support in said unit.

* * * * *